US006162522A

United States Patent [19]

Deka et al.

[11] Patent Number: 6,162,522

[45] Date of Patent: Dec. 19, 2000

[54] LOOP SUBSTRATE FOR RELEASABLY ATTACHABLE ABRASIVE SHEET MATERIAL

[75] Inventors: Ganesh Chandra Deka, Duluth; Samuel Lee Sykes, Alpharetta, both of Ga.

[73] Assignee: Kimberly-Clark Worldwide, Inc., Neenah, Wis.

[21] Appl. No.: 09/100,576

[22] Filed: Jun. 19, 1998

[51] Int. Cl.[7] ..... B32B 3/06

[52] U.S. Cl. ..... 428/99; 428/88; 428/92; 428/100; 428/101; 428/143; 442/151; 442/364; 442/409; 442/411; 24/448

[58] Field of Search ..... 428/88, 99, 92, 428/100, 101, 143; 442/151, 364, 409, 411; 24/448

[56] References Cited

U.S. PATENT DOCUMENTS

| | | | |
|---|---|---|---|
| 5,326,612 | 7/1994 | Goulait | 428/100 |
| 5,595,567 | 1/1997 | King et al. | 604/391 |
| 5,611,791 | 3/1997 | Gorman et al. | 604/391 |
| 5,614,281 | 3/1997 | Jackson et al. | 428/100 |
| 5,616,394 | 4/1997 | Gorman et al. | 428/99 |
| 5,652,051 | 7/1997 | Shawver et al. | 442/362 |
| 5,669,900 | 9/1997 | Bullwinkel et al. | 604/391 |
| 5,695,377 | 12/1997 | Triebes et al. | 442/359 |
| 5,707,468 | 1/1998 | Arnold et al. | 156/62.6 |
| 5,718,972 | 2/1998 | Murase et al. | 428/360 |
| 5,763,041 | 6/1998 | Leak et al. | 428/100 |
| 5,773,120 | 6/1998 | Deka et al. | 428/99 |

FOREIGN PATENT DOCUMENTS

| | | | |
|---|---|---|---|
| 0 341 993 | 11/1989 | European Pat. Off. . | |
| 0 659 924 | 6/1995 | European Pat. Off. . | |
| 02234965 | 9/1990 | Japan | D04H 1/54 |
| 93/03889 | 3/1993 | WIPO | B24D 3/00 |
| 95/13164 | 5/1995 | WIPO | B24D 3/00 |
| 96025133 | 8/1996 | WIPO . | |
| 97/24482 | 7/1997 | WIPO | D04H 1/54 |
| 97024482 | 7/1997 | WIPO . | |

*Primary Examiner*—Blaine Copenheaver
*Assistant Examiner*—Ula C. Ruddock
*Attorney, Agent, or Firm*—Steven D. Flack

[57] ABSTRACT

A loop material suitable for use with a hook-and-loop fastening system, wherein the loop material includes a first fibrous nonwoven web having a first surface and a second surface and includes carded sheath-core bicomponent staple fibers in which the fibers have a sheath-core melting point differential of at least about 20° C. and a length of from about 10 mm to about 65 mm. The first fibrous nonwoven web has a thickness of at least about 0.15 mm and a basis weight of at least about 20 grams per square meter; a pattern on the first surface thereof of continuous bonded areas defining a plurality of discrete unbonded areas formed by the application of heat and pressure, wherein individual fibers within the discrete unbonded areas have at least a portion thereof extending into and bonded within the continuous bonded areas; and a percent bonded area of from about 20 to about 50 percent. If desired, a film layer may be bonded to the second surface of the first fibrous nonwoven web. Alternatively, a second fibrous nonwoven web may be bonded or laminated to the second surface of the first fibrous nonwoven web. The loop material is particularly suitable for the preparation of a releasably attachable abrasive sheet material.

18 Claims, 2 Drawing Sheets

LOOP SUBSTRATE FOR RELEASABLY ATTACHABLE ABRASIVE SHEET MATERIAL

BACKGROUND OF THE INVENTION

The present invention relates to a loop substrate suitable for use with a hook-and-loop fastening system. The present invention also relates to an abrasive sheet material.

Abrasive sheet materials are widely used for a variety of applications and include, by way of illustration only, sandpapers, emery cloths, sanding discs for rotary sanders, and sanding strips for orbital and belt sanders. By utilizing very fine abrasive materials, abrasive sheet materials also can be used for polishing operations. Abrasive sheet materials most often comprise a layer of an abrasive, i.e., abrasive particles or grit, which is attached to a substrate or base of varying thickness and basis weight by means of an adhesive.

In some instances, the abrasive sheet material is used by itself or wrapped by hand around a block or pad. In other instances, the abrasive sheet material is attached at distal ends by mechanical means to a motorized sanding tool having a disc or pad. Because of the rapid movement of such a motorized sanding tool, the unattached edges of the abrasive sheet material are easily damaged or torn. It is, therefore, desirable that the abrasive sheet material is substantially completely attachable to the disc or pad of the sanding tool. For many applications, the abrasive sheet materials need to be readily exchanged for other sheets, either to replace worn-out sheets or to change to a finer or coarser grit.

Abrasive sheet materials which are substantially completely attachable to and readily removable from a sanding tool are known. In some embodiments, these materials are attached by a pressure-sensitive adhesive. In other embodiments, they include a looped fabric having a paper sheet attached to the back thereof by an adhesive. The free surface of the paper has an abrasive attached thereto by means of an adhesive. The looped fabric is attachable to a hook-type attachment means well known to those in the art.

Abrasive sheet materials based on a hook-and-loop attachment mechanism have several advantages over abrasive sheet materials which are attached to a sanding tool by means of a pressure-sensitive adhesive. For example, the former, unlike pressure-sensitive adhesive types, remain firmly attached even when heated or cooled excessively. In addition, they are easily and cleanly removed after use. However, because they are made from two separate layers which have been laminated together, they are costly to manufacture. Moreover, delamination can occur, particularly under conditions of high stress or temperature. Conditions of high stress also can result in unacceptable stretching of the loops in a loop material which is attached to a sanding tool by a hook-type attachment means. This can result in the separation of the sheet from the tool during use or prevent reattachment of the sheet after removal. In either case, the useful life of the sheet can be significantly reduced. Accordingly, there is a need for an improved loop material which will reduce or eliminate such problems, particularly for abrasive sheet materials to be used in high stress applications.

SUMMARY OF THE INVENTION

The present invention addresses some of the difficulties and problems discussed above by providing a loop material suitable for use with a hook-and-loop fastening system. The loop material includes a first fibrous nonwoven web having a first surface and a second surface and includes carded sheath-core bicomponent staple fibers in which the fibers have a sheath-core melting point differential of at least about 20° C. and a length of from about 10 mm to about 65 mm. For example, the sheath-core bicomponent staple fibers may have a length of from about 35 mm to about 55 mm. The first fibrous nonwoven web has a thickness of at least about 0.15 mm and a basis weight of at least about 20 grams per square meter; a pattern on the first surface thereof of continuous bonded areas defining a plurality of discrete unbonded areas formed by the application of heat and pressure, wherein individual fibers within the discrete unbonded areas have at least a portion thereof extending into and bonded within the continuous bonded areas; and a percent bonded area of from about 20 to about 50 percent. By way of example only, the thickness of the first fibrous nonwoven web may be at least about 0.2 mm. As another example, the thickness of the first fibrous nonwoven web may be from about 0.2 mm to about 1 mm. As still another example, the first fibrous nonwoven web may have a percent bonded area of from about 35 to about 45 percent.

If desired, a film layer may be bonded or laminated to the second surface of the first fibrous nonwoven web. Alternatively, a second fibrous nonwoven web may be bonded or laminated to the second surface of the first fibrous nonwoven web.

The loop material of the present invention is particularly suitable for the preparation of a releasably attachable abrasive sheet material, described hereinafter. Some embodiments, however, may be used as part of a hook-and-loop fastening system in such disposable products as diapers, incontinent products, medical garments, and the like. Such embodiments typically do not require the presence of a second layer, such as a film or another nonwoven web as described above.

The present invention further provides a releasably attachable abrasive sheet material which includes a first fibrous nonwoven web as described hereinabove. Such sheet material also includes a backing layer bonded to the second surface of the first fibrous nonwoven web and a layer of abrasive particles bonded to the backing layer. For example, the layer of abrasive particles may be bonded to the backing layer by a layer of adhesive. As another example, the layer of abrasive particles may be coated with a layer of adhesive.

The present invention also provides a releasably attachable abrasive sheet material which includes a first fibrous nonwoven web as described hereinabove. A second fibrous nonwoven web is bonded to the second surface of the first fibrous nonwoven web and a film is bonded to the second fibrous nonwoven web. Finally, a layer of abrasive particles is bonded to the film. By way of example only, the layer of abrasive particles may be bonded to the film by a layer of adhesive. Also by way of example, the layer of abrasive particles may be coated with a layer of adhesive.

The present invention further provides a releasably attachable abrasive sheet material which includes a first fibrous nonwoven web as described hereinabove. A second fibrous nonwoven web is bonded to the second surface of the first fibrous nonwoven web. A backing layer is bonded to the second fibrous nonwoven web and a layer of abrasive particles is bonded to the backing layer. As before, the layer of abrasive particles may be bonded to the backing layer by a layer of adhesive. Also by way of example, the layer of abrasive particles may be coated with a layer of adhesive. The second fibrous nonwoven web may be a spunbonded web or a web of carded staple fibers.

DETAILED DESCRIPTION OF THE INVENTION

Figure 1:
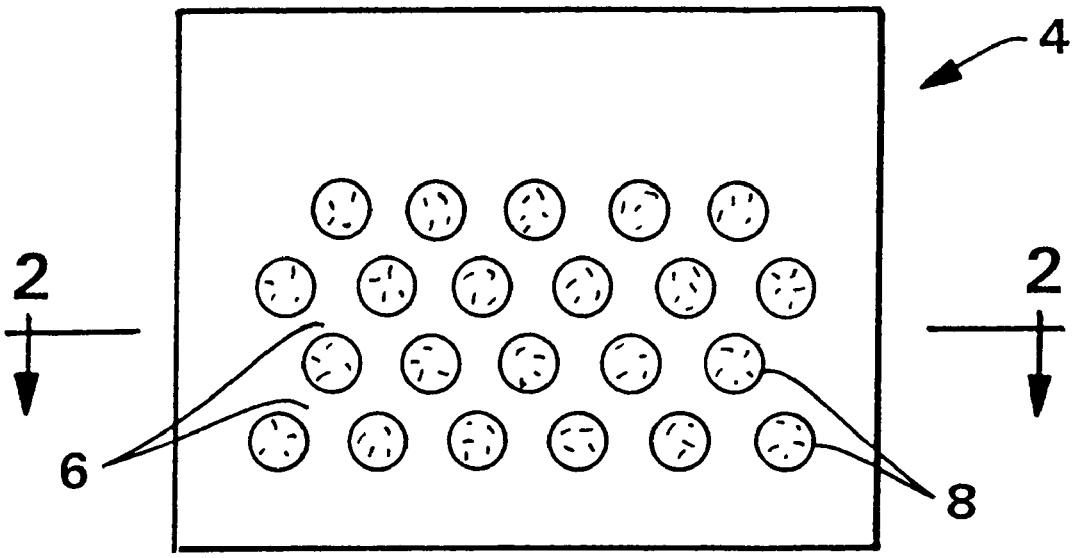
FIG. 1 is a diagrammatic, top elevational view of the first fibrous nonwoven web of the present invention.

The loop material of the present invention includes a first fibrous nonwoven web having a first surface and a second surface and includes carded sheath-core bicomponent staple fibers in which the fibers have a sheath-core melting point differential of at least about 20° C. and a length of from about 10 mm to about 65 mm. For example, the sheath-core bicomponent staple fibers may have a length of from about 35 mm to about 55 mm. The first fibrous nonwoven web has a thickness of at least about 0.15 mm and a basis weight of at least about 20 grams per square meter; a pattern on the first surface thereof of continuous bonded areas defining a plurality of discrete unbonded areas formed by the application of heat and pressure, wherein individual fibers within the discrete unbonded areas have at least a portion thereof extending into and bonded within the continuous bonded areas; and a percent bonded area of from about 20 to about 50 percent. By way of example only, the thickness of the first fibrous nonwoven web may be at least about 0.2 mm. As another example, the thickness of the first fibrous nonwoven web may be from about 0.2 mm to about 1 mm. As still another example, the first fibrous nonwoven web may have a percent bonded area of from about 35 to about 45 percent.

As used herein, the term "bicomponent staple fibers" refers to staple fibers which have been formed from at least two thermoplastic polymers extruded from separate reservoirs but spun together to form one fiber. The polymers are arranged in substantially constantly positioned distinct zones across the cross-section of the bicomponent fibers and extend continuously along the length of the bicomponent fibers. The configuration of such a bicomponent fiber is a sheath-core arrangement wherein one polymer is surrounded by another. Bicomponent fibers are taught, for example, in U.S. Pat. No. 5,108,820 to Kaneko et al., U.S. Pat. No. 5,336,552 to Strack et al., and European Pat. No. 0 586 924. The component polymers may be present in any desired ratio.

The term "sheath-core melting point differential" as used herein is simply the melting point, expressed in degrees Celsius, of the polymer of which the core is composed minus the melting point, also expressed in degrees Celsius, of the polymer of which the sheath is composed.

The first fibrous nonwoven web utilized in the present invention has continuous bonded areas which define a plurality of discrete unbonded areas. Even though such nonwoven web is prepared from staple fibers, it is surprisingly effective as a loop material in a hook-and-loop fastening system for an abrasive sheet material. By way of illustration, when the nonwoven web is a spunbonded polypropylene nonwoven web prepared from side-by-side bicomponent fibers as described in U.S. patent application Ser. No. 08/754,419, filed Dec. 17, 1996 in the names of Ty J. Stokes et al., which application is incorporated herein by reference in its entirety, such spunbonded web was not suitable for the preparation of a releasably attachable abrasive sheet material as described herein.

A suitable process for forming the first fibrous nonwoven web or loop material of the present invention includes providing a nonwoven fabric or web, providing opposedly positioned first and second calender rolls and defining a nip therebetween, with at least one of said rolls being heated and having a bonding pattern on its outermost surface comprising a continuous pattern of land areas defining a plurality of discrete openings, apertures or holes, and passing the nonwoven fabric or web within the nip formed by said rolls. Each of the openings in said roll or rolls defined by the continuous land areas forms a discrete unbonded area in at least one surface of the nonwoven fabric or web in which the fibers or filaments of the web are substantially or completely unbonded. Stated alternatively, the continuous pattern of land areas in said roll or rolls forms a continuous pattern of bonded areas that define a plurality of discrete unbonded areas on at least one surface of said nonwoven fabric or web. Alternative embodiments of the aforesaid process include pre-bonding the nonwoven fabric or web before passing the fabric or web within the nip formed by the calender rolls, or providing multiple nonwoven webs to form a pattern-unbonded laminate.

Figure 2:
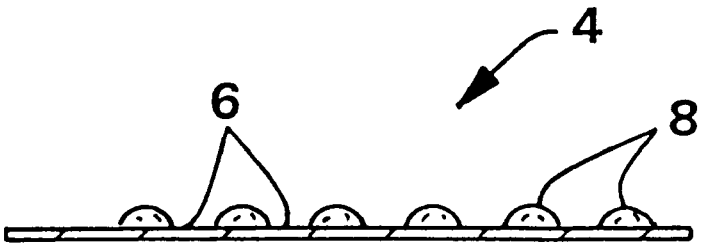
FIG. 2 is a diagrammatic cross-sectional side view of the first fibrous nonwoven web of FIG. 1.

Referring now to FIGS. 1 and 2, an embodiment of the first fibrous nonwoven web 4 of the present invention is illustrated. By way of definition, the term "pattern-unbonded nonwoven loop material" as used herein is intended to refer to a loop or female component for a hook and loop fastening system that comprises, in its simplest form, a nonwoven fabric or web having continuous bonded areas 6 that define a plurality of discrete, dimensionally-stabilized unbonded areas 8. Within the continuous bonded areas 6, the fibers or filaments of the nonwoven web are thoroughly bonded or fused together, and desirably are non-fibrous, whereas within the unbonded areas 8 the fibers or filaments of the nonwoven fabric or web are substantially or completely free of bonding or fusing and retain their fibrous structure. This term is not intended to limit the loop material of the present invention to only nonwoven materials; rather, the loop material of the present invention can be advantageously employed in alternative embodiments in which, for example, the pattern-unbonded nonwoven fabric or web is attached or bonded to a layer of film material. Nor is use of the term "loop" intended to limit the loop material of the present invention to only materials in which discrete, separately formed loops of material are employed to receive and engage the hook elements of a complementary hook material; rather, the loop material of the present invention includes fibrous nonwoven fabrics or webs in which the individual fibers or filaments function to engage the hook elements without such fibers or filaments being formed into discrete loops.

As used herein, the terms "layer" and "web" when used in the singular can have the dual meaning of a single element or a plurality of elements. As used herein, the term "laminate" means a composite material made from two or more layers or webs of material which have been attached or bonded to one another.

Figure 3:
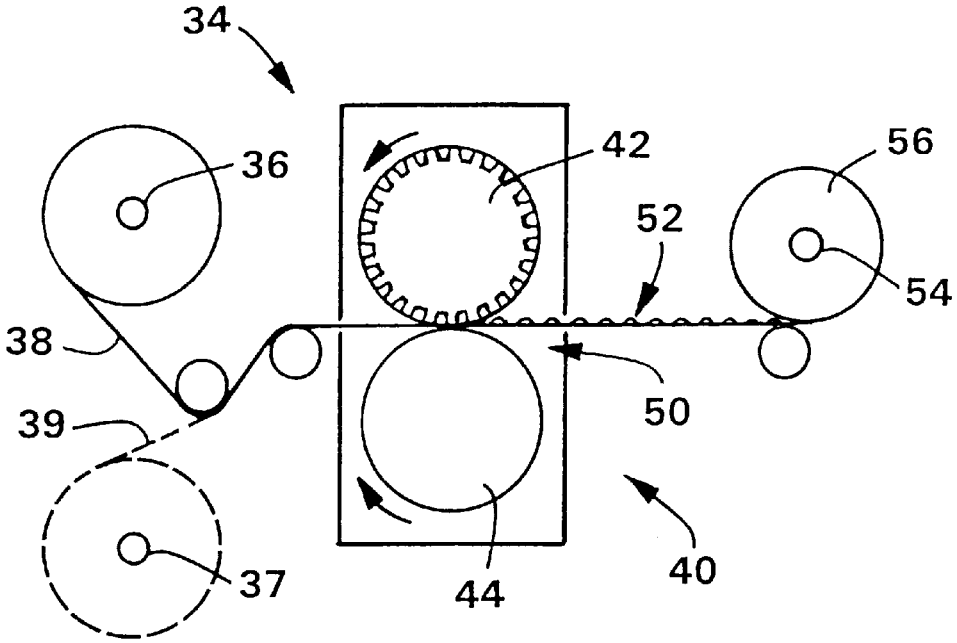
FIG. 3 is a schematic side view of a process and apparatus for making the first fibrous nonwoven web of the present invention.
Figure 4:
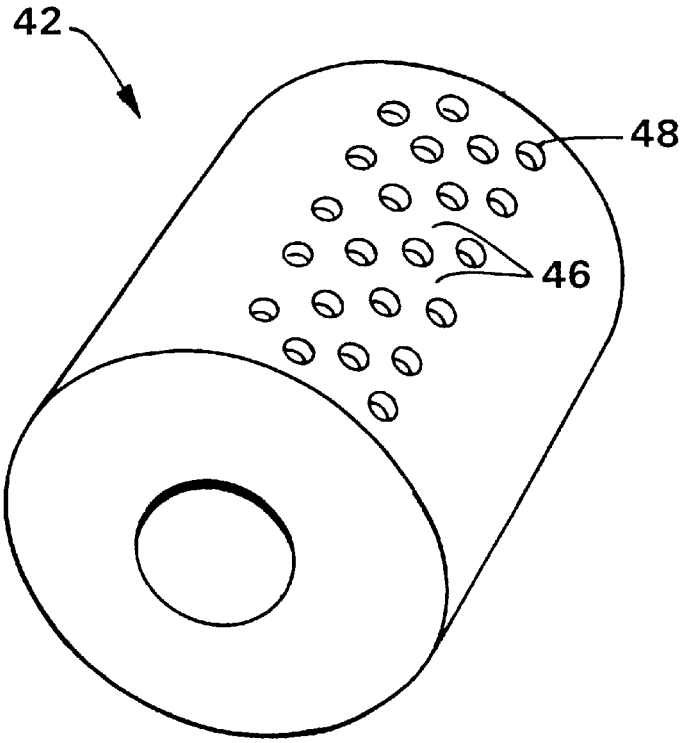
FIG. 4 is a partial perspective view of a pattern roll that may be used in accordance with the process and apparatus of FIG. 3.

After the nonwoven web is formed, the pre-bonded or unbonded web is passed through a suitable process and apparatus to form the pattern-unbonded nonwoven loop material of the present invention. Referring now to FIGS. 4 and 5, a process and apparatus for forming the pattern-unbonded nonwoven loop material of this invention now will be described. In FIG. 3, an apparatus for forming the pattern-unbonded nonwoven loop material of this invention is represented generally as element 34. The apparatus includes a first web unwind 36 for a first web 38. Optionally, one or more additional web unwinds 37 (shown in phantom) for additional webs or layers 39 may be employed in forming multi-layer pattern-unbonded laminates. It should be understood that although the apparatus shown in FIG. 3 illustrates a web unwind 36, the pattern-unbonding assembly 40 may be placed in a continuous (in-line) process with the nonwoven forming equipment described herein. As used herein, the term "pattern-unbonding assembly" should not be construed as apparatus for disassembling, destroying or removing existing bonds, if any, in web 38; rather, pattern-unbonding assembly refers to apparatus that continuously bonds or fuses the fibers or filaments forming web 38 in specified areas of the web, and prevents bonding or fusing of the fibers or filaments of web 38 in other specified areas of the web, such areas being referred to herein as bonded areas and unbonded areas, respectively.

First web 38 (or simply "web" if only one unwind is used) is taken off the unwind 36 and passed into a pattern-unbonding assembly 40 that includes a first or pattern roll 42 and a second or an anvil roll 44, both of which are driven by conventional drive means, such as, for example, electric motors (not shown). Pattern roll 42 is a right circular cylinder that may be formed of any suitable, durable material, such as, for example, steel, to reduce wear on the rolls during use. Pattern roll 42 has on its outermost surface a pattern of land areas 46 that define a plurality of discrete openings or apertures 48. The land areas 46 are designed to form a nip with the smooth or flat outer surface of opposedly positioned anvil roll 44, which also is a right circular cylinder that can be formed of any suitable, durable material.

The size, shape, number and configuration of openings 48 in pattern roll 42 can be varied to meet the particular end-use needs of the pattern-unbonded nonwoven loop material being formed thereby. In order to reduce the incidence of fiber pull-out in the resulting loop material, the size of openings 48 in pattern roll 42 should be dimensioned to reduce the likelihood that the entire length of the filaments or fibers forming an unbonded area will lie within a single unbonded area. Stated differently, fiber length should be selected to reduce the likelihood that the entire length of a given fiber or filament will fall within a single unbonded area. On the other hand, the desirability of restricting the size of the openings 48 in pattern roll 42, and the unbonded areas 8 formed thereby in the pattern-unbonded nonwoven loop material 4, is counter-balanced by the need for the unbonded areas 8 to have sufficient size to provide the required engagement areas for the hook elements of a complementary hook material. Circular openings 48 as shown in FIG. 4 hereof having an average diameter ranging from about 0.05 inch (about 0.13 cm) to about 0.25 inch (about 0.64 cm), and more specifically, from about 0.13 inch (0.33 cm) to about 0.16 inch (0.41 cm), and a depth measured from the outermost surface of pattern roll 42 of at least about 0.02 inch (about 0.05 cm), and more particularly at least about 0.06 inch (0.15 cm), are considered suitable in forming the pattern-unbonded nonwoven material of the present invention. While openings 48 in pattern roll 42 as shown in FIG. 4 are circular, other shapes, such as ovals, squares, diamonds and the like can be advantageously employed.

The number or density of openings 48 in pattern roll 42 also can be selected to provide the requisite amount of engagement areas for hook elements, without unduly limiting the size of the continuous bonded areas and giving rise to increased incidence of fiber pull-out. Pattern rolls having an opening density in the range of from about 1 opening per square centimeter ($cm^2$) to about 25 openings/$cm^2$, and more particularly from about 5 to about 7 openings/$cm^2$, may be utilized to advantage in forming the pattern-unbonded loop material of the present invention.

Moreover, the spacing between individual openings 48 can be selected to enhance the hook engagement functionality of the resulting pattern-unbonded loop material, without overly reducing the portion of the pattern-unbonded loop material occupied by continuous bonded areas, which serve to lessen fiber pull-out. Suitable inter-opening spacings for the embodiment shown can range from about 0.13 inch (about 3.3 mm) to about 0.22 inch (about 5.6 mm), centerline-to-centerline, in the machine and cross-machine directions. As used herein, the term "machine direction" or MD means the length of a material or fabric in the direction in which it is produced (from left to right in FIG. 3). The term "cross-machine direction" or CD means the width of a material or fabric, i.e., a direction generally perpendicular to the MD.

The particular arrangement or configuration of openings 48 in pattern roll 42 is not considered critical, so long as in combination with the opening size, shape and density, the desired levels of surface integrity and durability and hook element engagement are achieved. For example, as shown in FIG. 4, the individual openings 48 are arranged in staggered rows (see also FIG. 1). Other different configurations are considered within the scope of the present invention.

The portion of the outermost surface of the pattern roll 42 occupied by continuous land areas 46 likewise can be modified to satisfy the contemplated enduse application of the pattern-unbonded material. The degree of bonding imparted to the pattern-unbonded nonwoven loop material by the continuous land areas 46 can be expressed as a percent bond area, which refers to the portion of the total plan area of at least one surface of pattern-unbonded nonwoven loop material 4 (see FIG. 1) that is occupied by bonded areas 6. Stated generally, the lower limit on the percent bond area suitable for forming the pattern-unbonded nonwoven loop material 4 of the present invention is the point at which fiber pull-out excessively reduces the surface integrity and durability of the pattern-unbonded material. The required percent bond area will be affected by a number of factors, including the type(s) of polymeric materials used in forming the fibers or filaments of the nonwoven web, whether the nonwoven web is a single- or multi-layer fibrous structure, whether the nonwoven web is unbonded or pre-bonded prior to passing into the pattern-unbonding assembly, and the like. Pattern-unbonded nonwoven loop materials having percent bond areas ranging from about 25% to about 50%, and more particularly from about 36% to about 50%, have been found suitable.

The temperature of the outer surface of pattern roll 42 can be varied by heating or cooling relative to anvil roll 44. Heating and/or cooling can affect the features of the web(s) being processed and the degree of bonding of single or multiple webs being passed through the nip formed between the counterrotating pattern roll 42 and anvil roll 44. In the embodiment shown in FIG. 3, for example, both pattern roll 42 and anvil roll 44 are heated, desirably to the same bonding temperature. The specific ranges of temperatures to be employed in forming the pattern-unbonded nonwoven loop material hereof are dependent upon a number of factors, including the types of polymeric materials employed in forming the pattern-unbonded material, the inlet or line speed(s) of the nonwoven web(s) passing through the nip formed between pattern roll 42 and anvil roll 44, and the nip pressure between pattern roll 42 and anvil roll 44.

Anvil roll 42 as shown in FIG. 3 has an outer surface that is much smoother than pattern roll 42, and preferably is smooth or flat. It is possible, however, for anvil roll 44 to have a slight pattern on its outer surface and still be considered smooth or flat for purposes of the present invention. For example, if anvil roll 44 is made from a softer material or has a softer surface, such as resin impregnated cotton or rubber, it will develop surface irregularities, yet it will still be considered smooth or flat for purposes of the present invention. Such surfaces are collectively referred to herein as "flat." Anvil roll 44 provides the base for pattern roll 42 and the web or webs of material to contact. Typically, anvil roll 44 will be made from steel, or materials such as hardened rubber, resin-treated cotton or polyurethane.

Alternatively, anvil roll 44 may be replaced with a pattern roll (not shown) having a pattern of continuous land areas defining a plurality of discrete, apertures or openings therein, as in the above-described pattern roll 42. In such case, the pattern-unbonding assembly would include a pair of counter-rotating pattern rolls which would impart a pattern of continuous bonded areas defining a plurality of discrete unbonded areas on both the upper and lower surfaces of the pattern-unbonded nonwoven loop material. Rotation of the opposedly positioned pattern rolls can be synchronized, such that the resulting unbonded areas on the surfaces of the pattern-unbonded material are vertically aligned or juxtaposed.

Referring again to FIG. 3, pattern roll 42 and anvil roll 44 are rotated in opposite directions to one another so as to draw the nonwoven web (or webs) through the nip area defined therebetween. Pattern roll 42 has a first rotational speed measured at its outer surface and anvil roll 44 has a second rotational speed measured at its outer surface. In the embodiment shown, the first and second rotational speeds are substantially identical. However, the rotational speeds of the pattern and anvil rolls can be modified to create a speed differential between the counter-rotating rolls.

The locations of the opposedly positioned pattern roll 42 and anvil roll 44 may be varied to create a nip area 50 between the rolls. The nip pressure within nip area 50 can be varied depending upon the properties of the web itself or webs themselves and the degree of bonding desired. Other factors that will allow variances in the nip pressure will include the temperatures of the pattern roll 42 and anvil roll 44, the size and spacing of openings 48 in pattern roll 42, as well as the types of polymeric materials used in forming the pattern-unbonded nonwoven material. With respect to the degree of bonding to be imparted to the pattern-unbonded nonwoven loop material within the continuous bonded areas, the pattern-unbonded material desirably is thoroughly bonded or melt-fused in the bonded areas, such that the polymeric material is rendered non-fibrous. This high degree of bonding is important in stabilizing the portions of the fibers or filaments within the unbonded areas extending into the continuous bonded areas and reducing fiber pull-out when hook elements are disengaged from the discrete unbonded areas.

If desired, a film layer may be bonded to the second surface of the first fibrous nonwoven web. In general, the film may be prepared from any polymer. For example, the polymer may be a thermosetting or a thermoplastic polymer. As used herein, the term "thermosetting polymer" refers to a polymer which solidifies or "sets" irreversibly when heated. This property is almost invariably associated with a crosslinking reaction of the molecular constituents induced by heat or irradiation. In many cases, it is necessary to add curing agents such as organic peroxides or (in the case of natural rubber) sulfur to achieve crosslinking. For example, thermoplastic linear polyethylene can be cross-linked to a thermosetting material either by radiation or by chemical reaction.

Examples of thermosetting polymers include, by way of illustration only, alkyd resins, such as phthalic anhydride-glycerol resins, maleic acid-glycerol resins, adipic acid-glycerol resins, and phthalic anhydride-pentaerythritol resins; allylic resins, in which such monomers as diallyl phthalate, diallyl isophthalate diallyl maleate, and diallyl chlorendate serve as nonvolatile cross-linking agents in polyester compounds; amino resins, such as aniline-formaldehyde resins, ethylene urea-formaldehyde resins, dicyandiamide-formaldehyde resins, melamine-formaldehyde resins, sulfonamide-formaldehyde resins, and urea-formaldehyde resins; epoxy resins, such as cross-linked epichlorohydrin-bisphenol A resins; phenolic resins, such as phenol-formaldehyde resins, including Novolacs and resols; and thermosetting polyesters, silicones, and urethanes.

As used herein, the term "thermoplastic polymer" refers to a polymer that softens when exposed to heat and returns to its original condition when cooled to room temperature. Natural substances which exhibit this behavior are crude rubber and a number of waxes. More generally, examples of thermoplastic polymers include, by way of illustration only, end-capped polyacetals, such as poly(oxymethylene) or polyformaldehyde, poly(trichloroacetaldehyde), poly(n-valeraldehyde), poly(acet-aldehyde), and poly (propionaldehyde); acrylic polymers, such as polyacrylamide, poly(acrylic acid), poly(methacrylic acid), poly(ethyl acrylate), and poly(methyl methacrylate); fluorocarbon polymers, such as poly(tetrafluoroethylene), perfluorinated ethylene-propylene copolymers, ethylene-tetrafluoroethylene copolymers, poly (chlorotrifluoroethylene), ethylen-chlorotrifluoroethylene copolymers, poly(vinyl-idene fluoride), and poly(vinyl fluoride); polyamides, such as poly(6-aminocaproic acid) or poly(e-caprolactam), poly(hexamethylene adipamide), poly (hexamethylene sebacamide), and poly(11-aminoundecanoic acid); polyaramides, such as poly(imino-1,3-phenyleneiminoisophthaloyl) or poly(m-phenylene isophthalamide); parylenes, such as poly-p-xylylene and poly(chloro-p-xylylene); polyaryl ethers, such as poly(oxy-2,6-dimethyl-1,4-phenylene) or poly(p-phenylene oxide); polyaryl sulfones, such as poly(oxy-1,4-phenylenesulfonyl-1,4-phenyleneoxy-1,4-phenyleneisopropyli-dene-1,4-phenylene) and poly(sulfonyl-1,4-phenyleneoxy-1,4-phenylenesulfonyl-4,4'-biphenylene); polycarbonates, such as poly(bisphenol A) or poly(carbonyldioxy-1,4-phenyleneisopropylidene-1,4-phenylene); polyesters, such as poly(ethylene tere-phthalate), poly(tetramethylene terephthalate), and poly(cyclohexylene-1,4-dimethyl-ene terephthalate) or poly(oxymethylene-1,4-cyclohexylenemethyleneoxyterephthal-oyl); polyaryl sulfides, such as poly(p-phenylene sulfide) or poly(thio-1,4-phenylene); polyimides, such as poly(pyromellitimido-1,4-phenylene); polyolefins, such as poly-ethylene, polypropylene, poly(1-butene), poly(2-butene), poly(1-pentene), poly(2-pentene), poly(3-methyl-1-pentene), and poly(4-methyl-1-pentene); vinyl polymers, such as poly (vinyl acetate), poly(vinylidene chloride), and poly(vinyl chloride); diene polymers, such as 1,2-poly-1,3-butadiene, 1,4-poly-1,3-butadiene, polyisoprene, and polychloroprene; polystyrenes; copolymers of the foregoing, such as acrylonitrile-butadienestyrene (ABS) copolymers; and the like.

As a practical matter, the film layer desirably will be a thermoplastic film layer. For example, a preformed film may be laminated by known means to the second surface of the first fibrous nonwoven web. Known means for laminating the film to the first fibrous nonwoven web include adhesives and thermal bonding, including thermal point bonding. Alternatively, a film may be formed on the second surface of the first fibrous nonwoven web by melt extrusion.

In place of a film layer, a second fibrous nonwoven web may be bonded or laminated to the second surface of the first fibrous nonwoven web, again by known means. Such web may be prepared from any polymer as described above for films. The web desirably will be prepared from a thermoplastic polymer. The term "nonwoven web" is used herein with respect to the second fibrous nonwoven web to mean a web having a structure of individual fibers which are interlaid in a generally random manner, not in an identifiable manner as in a knitted fabric, and is intended to include any nonwoven web. For example, the term includes those prepared by such well-known melt-extrusion processes as meltblowing, coforming, and spunbonding. Such processes are exemplified by the following references, each of which is incorporated herein by reference:

(a) meltblowing references include, by way of example, U.S. Pat. No. 3,016,599 to R. W. Perry, Jr., U.S. Pat. No. 3,704,198 to J. S. Prentice, U.S. Pat. No. 3,755,527 to J. P. Keller et al., U.S. Pat. No. 3,849,241 to R. R. Butin et al., U.S. Pat. No. 3,978,185 to R. R. Butin et al., and U.S. Pat. No. 4,663,220 to T. J. Wisneski et al. See, also, V. A. Wente, "Superfine Thermoplastic Fibers", *Industrial and Engineering Chemistry*, Vol. 48, No. 8, pp. 1342–1346 (1956); V. A. Wente et al., "Manufacture of Superfine Organic Fibers", Navy Research Laboratory, Washington, D.C., NRL Report 4364 (111437), dated May 25, 1954, United States Department of Commerce, Office of Technical Services; and Robert R. Butin and Dwight T. Lohkamp, "Melt Blowing—A One-Step Web Process for New Nonwoven Products", *Journal of the Technical Association of the Pulp and Paper Industry*, Vol. 56, No. 4, pp. 74–77 (1973);

(b) coforming references include U.S. Pat. No. 4,100,324 to R. A. Anderson et al. and U.S. Pat. No. 4,118,531 to E. R. Hauser; and (c) spunbonding references include, among others, U.S. Pat. No. 3,341,394 to Kinney, U.S. Pat. No. 3,655,862 to Dorschner et al., U.S. Pat. No. 3,692,618 to Dorschner et al., U.S. Pat. No. 3,705,068 to Dobo et al., U.S. Pat. No. 3,802,817 to Matsuki et al., U.S. Pat. No. 3,853,651 to Porte, U.S. Pat. No. 4,064,605 to Akiyama et al., U.S. Pat. No. 4,091,140 to Harmon, U.S. Pat. No. 4,100,319 to Schwartz, U.S. Pat. No. 4,340,563 to Appel and Morman, U.S. Pat. No. 4,405,297 to Appel and Morman, U.S. Pat. No. 4,434,204 to Hartman et al., U.S. Pat. No. 4,627,811 to Greiser and Wagner, and U.S. Pat. No. 4,644,045 to Fowells.

Other methods for preparing nonwoven webs are known and may be employed. For example, the term also includes nonwoven webs prepared from relatively short fibers to form a web or sheet. Methods employed to prepare such webs include air laying, wet laying, carding, and the like. In some cases, it may be either desirable or necessary to stabilize the nonwoven web by known means, such as thermal pattern bonding (i.e., pattern bonding by the application of heat and pressure), through-air bonding, and hydroentangling.

The phrase "pattern bonding by the application of heat and pressure" means any process by which a nonwoven web is passed through a nip formed by a pair of opposed rolls. Either or both rolls may have a regular or irregular surface pattern of continuous lands and grooves or isolated (discontinuous) projections, For example, the nonwoven web may be pattern bonded by the application of heat and pressure in the ranges of from about 80° C. to about 180° C. and from about 150 to about 1,000 pounds per linear inch (from about 59 kg/cm to about 178 kg/cm), respectively, employing a pattern with from about 10 to about 1,000 bond regions/inch$^2$ (from about 1 to about 155 bond regions/cm$^2$) covering from about 5 to about 50 percent of the web surface area. representative of known pattern bonding procedures are, by way of example only, U.S. Design Pat. No. 239,566 to Vogt, U.S. Design Pat. No. 264,512 to Rogers, U.S. Pat. No. 3,855,046 to Hansen et al., and U.S. Pat. No. 4,493,868 to Meitner.

Desirably, the second fibrous nonwoven web will be prepared from a thermoplastic polyolefin. In general, the term "thermoplastic polyolefin" is used herein to mean any thermoplastic polyolefin which can be used for the preparation of nonwoven webs. Examples of thermoplastic polyolefins include polyethylene, polypropylene, poly(1-butene), poly(2-butene), poly(1-pentene), poly(2-pentene), poly(3-methyl-1-pentene), poly(4-methyl-1-pentene), and the like. In addition, such term is meant to include blends of two or more polyolefins and random and block copolymers prepared from two or more different unsaturated monomers. Because of their commercial importance, the more desired polyolefins are polyethylene and polypropylene.

The term "carded web" is used herein to mean a nonwoven web prepared from staple fibers which are usually purchased in bales. The bales are placed in a picker which separates the fibers. Next, the fibers are sent through a combing or carding unit which further breaks apart and aligns the staple fibers in the machine direction so as to form a machine direction-oriented fibrous nonwoven web. Once the web has been formed, it is then bonded by one or more of several bonding methods.

As used herein, the term "bonded carded web" means a carded web as described above, in which the fibers of which the web is composed have been bonded together to form a plurality of interfiber bonds.

The term "through-air bonding" is used herein to mean a process of bonding a nonwoven bicomponent fiber web. The process involves winding the web at least partially around a screen-covered drum which is enclosed in a hood. Air which is sufficiently hot to melt one of the polymers of which the fibers of the web are made (e.g., the sheath polymer of the bicomponent thermoplastic polymer fibers) is forced from the hood, through the web and into the perforated roller. The air velocity may be, by way of example, between 100 and 500 feet per minute and the dwell time may be as long as 6 seconds. The melting and resolidification of the polymer provide the bonding.

The term "through air bonding" also includes the use of a hot air knife as described in commonly assigned U.S. patent application Ser. No. 08/362,328, filed on Dec. 22, 1994, which is incorporated herein by reference. Briefly, a hot air knife is a device which focuses a stream of heated air at a high linear flow rate onto a carded nonwoven web. For example, the linear flow rate of the stream of heated air may be in a range of from about 300 to about 3,000 meters per minute and the temperature of the stream may be in a range of from about 90° C. to about 290° C. Higher temperatures may be used, depending upon the melting point of the polymer employed as the first or sheath component in the bicomponent thermoplastic polymer fibers present in the web. The stream of heated air is arranged and directed by at least one slot which typically has a width of from about 3 to about 25 mm and is oriented in a substantially cross-machine direction over substantially the entire width of the web. A plurality of slots may be employed, if desired, and they may be arranged next to or separate from each other. The at least one slot may be continuous or discontinuous and may be composed of closely spaced holes. The hot air knife has a plenum to distribute and contain the heated air prior to exiting the slot. The plenum pressure of the air usually is from about 2 to about 22 mm Hg. The hot air knife typically is positioned from about 6 to about 254 mm above the surface of the carded web The present invention further provides a releasably attachable abrasive sheet material which includes a first fibrous nonwoven web as described hereinabove. Such sheet material also includes a layer of abrasive particles bonded to the second surface of the first fibrous nonwoven web. For example, the layer of abrasive particles may be bonded to the second surface of the first fibrous nonwoven web by a layer of adhesive. As another example, the layer of abrasive particles may be coated with a layer of adhesive.

The present invention also provides a releasably attachable abrasive sheet material which includes a first fibrous nonwoven web as described hereinabove. A film or a second fibrous nonwoven web is bonded to the second surface of the first fibrous nonwoven web and a layer of abrasive particles is bonded to the film or second fibrous nonwoven web. By way of example only, the layer of abrasive particles may be bonded to the film or second fibrous nonwoven web by a layer of adhesive. Also by way of example, the layer of abrasive particles may be coated with a layer of adhesive.

Any of the known types of adhesives can be used to bond the abrasive particles to the coating of synthetic polymeric composition. For example, the adhesive may be thermosetting adhesive, such as, by way of illustration only, epoxy resins, phenolics, polyurethanes, polyesters, and alkyds. Water-based dispersions such as an ammonia-dispersed ethylene-vinyl acetate copolymer also can be employed. The selection of adhesive typically is dictated by the end use, but the adhesive must be compatible with the synthetic polymeric coating over which it is applied. Phenolics are most useful for very tough, coarse abrasive products for rough finishing or shaping, especially where the product needs to be waterproof as well. More flexible adhesives such as epoxy resins and alkyds are also waterproof and are desirable for fine-finishing products.

In general, any of the commonly employed abrasive materials known to those having ordinary skill in the art can be used. Such materials can vary from very coarse to very fine. Exemplary abrasive materials include silicon carbide, aluminum oxide, garnet, and diamond, by way of illustration only.

If desired, one or more layers of an adhesive or other material can be formed over the layer of abrasive particles. Such a layer can serve to better anchor all of the abrasive particles to the abrasive sheet material, thereby reducing abrasive loss during use and increasing the life of the abrasive sheet material.

The synthetic polymeric composition can be applied neat, as a solution in a suitable solvent, or as a dispersion in water or other liquid by methods well known to those having ordinary skill in the art. In some embodiments, processes which apply a viscous, high solids content fluid to the surface of a sheet material are utilized. Such processes can utilize 100 percent solids compositions which include, by way of illustration only, ultraviolet radiation curable acrylics and liquid epoxy thermosets. Such compositions can be applied with, for example, slot die coaters and knife-over-roll coaters. In addition, thermoplastic powder coating methods can be employed, such as electrostatic coating methods. In other embodiments, processes such as hot melt coating and melt extrusion which apply a molten composition directly to the fabric are employed, particularly where the fabric is exceptionally porous and open in nature. If desired, the synthetic polymeric composition can be preformed into, for example, a film which then can be bonded to the second surface of the fabric by heat or an adhesive layer.

Any generally accepted means of applying adhesive to a sheet material can be employed, including such methods as roll, reverse roll, gravure, and Meyer rod coating. It generally is desirable to avoid placing the fabric under significant tension in order to minimize fabric distortion, especially when the adhesive is being heat cured. Curing temperatures desirably will be kept below about 125° C., as higher temperatures also tend to distort the fabric.

The present invention is further described by the examples which follow. Such examples, however, are not to be construed as limiting in any way either the spirit or the scope of the present invention.

EXAMPLE 1

In this and all other examples, each sample of the first fibrous nonwoven web (or pattern-unbonded nonwoven loop material) was formed using the process and apparatus described herein, and illustrated in FIGS. 4 and 5. In forming each first fibrous nonwoven web, the carded bicomponent web was passed through the nip formed between two counter-rotating thermal bonding rolls including a pattern roll and an anvil roll. The outer surface of the pattern roll included a pattern of land areas defining a plurality of discrete openings. The land areas occupied about 36% of the total area of the pattern roll outer surface. The openings in the pattern roll were circular, arranged in staggered rows, had an average diameter of 0.16 inch (about 0.41 cm), had a depth of 0.06 inch (about 0.15 cm), and had a density of about 5 openings/cm$^2$. Centerline-to-centerline spacings between openings were 0.165 inch (about 0.41 cm) in the machine direction and 0.19 inch (about 0.48 cm) in the cross-machine direction. The outer surface of the anvil roll was substantially smooth.

The carded web employed in this example was prepared from standard highly crimped thermobondable bicomponent fibers having a sheath-core configuration (Type TPC, Chisso Corporation, Osaka, Japan). The sheath was composed of a polypropylene copolymer having a melting point of about 140° C. and the core was composed of standard polypropylene having a melting point of about 170° C. The staple fibers had a denier per filament (dpf) of 4.5 and were about 51 mm in length. The fibers were carded to give a nonwoven web having a basis weight of 62–65 grams per square meter (gsm). The resulting web was thermally bonded as described above with the top pattern roll having a temperature of 270° F. (about 132° C.) and the smooth anvil roll having a temperature of 271° F. (about 132° C.). The nip pressure during bonding was 400 pounds per square inch or psi (about 28 kilograms per square centimeter or kg/cm$^2$.

EXAMPLE 2

The procedure of Example 1 was repeated, except that the bicomponent fibers had a dpf of 6.0 and the thermal bonding was carried out with the temperature of both rolls at 281° F. (about 138° C.).

EXAMPLE 3

The procedure of Example 1 was repeated, except that the staple fibers were polyethylene-polypropylene sheath-core bicomponent fibers having a dpf of 6.0 and a length of 51 mm (Type ESC, Guangzhou ES Fiber Co., Ltd, Guangzhou, Guangduang Province, China). The basis weight of the resulting web was 41–45 gsm. Thermal bonding was carried out with the top pattern roll temperature at 278° F. (about 137° C.) and the bottom smooth roll temperature at 279° F. (about 137 C.).

EXAMPLE 4

The procedure of Example 3 was repeated, except that the basis weight of the carded web was increased to 61–65 gsm and the top pattern roll temperature was increased to 280° F. (about 138° C.).

EXAMPLE 5

A first fibrous nonwoven web was prepared as described in Example 1, except that the basis weight of the web was 41 gsm. A second fibrous nonwoven web consisting of a spunbonded polypropylene nonwoven web having a basis weight of 22 gsm was superimposed over the second surface of the first fibrous nonwoven web. The two layers then were thermally bonded as described in Example 1; the temperature of the top pattern roll was 281° F. (about 138° C.) and the temperature of the smooth bottom roll also was 281° F. (about 138° C.). The nip pressure was 400 psi (about 28 $kg/cm^2$). The basis weight of the resulting laminate was 63 gsm.

EXAMPLE 6

The procedure of Example 5 was repeated, except that the first fibrous nonwoven web was a web prepared as described in Example 1 with a basis weight of 63.5 gsm. The basis weight of the resulting laminate was 83.5 gsm.

EXAMPLE 7

The procedure of Example 5 was repeated, except that the second fibrous nonwoven web was a carded web prepared from 2.2 dpf polypropylene staple fibers; the web had a basis weight of 22 gsm. The resulting laminate had a basis weight of 63 gsm.

EXAMPLE 8

The second fibrous nonwoven web of the laminate of Example 5 was extrusion coated with high density polyethylene having a melt index of 11 g/10 minutes (presumably determined in accordance with ASTM D-1238) and a density of 0.947 $g/cm^3$ at a temperature of 610° F. (about 321° C.). The thickness of the coating was 1.5 mils (about 0.03 mm).

EXAMPLES 9 AND 10

The procedure of Example 8 was repeated with the laminates of Examples 6 and 7, respectively.

EXAMPLES 11–13

Each example employed a previously prepared abrasive sheet material. The material consisted of a paper base sheet, or backing, to which a make coat (adhesive layer) had been applied. Abrasive particles were layered on the make coat and the resulting layered structure was cured, typically at about 235° F. (about 113° C.) for three hours. The curing temperature and time in general are dependent upon the make coat and the anticipated application for the material. A size coat then was applied over the abrasive particles to help anchor the particles to the backing and to provide the desired physical strength properties of the finished material.

A layer of adhesive (Rhoplex N-1031, an acrylic latex from Rohm and Haas, Philadelphia, Pa.) was applied with a No. 34 Meyer rod to the side of the above-described abrasive sheet material to which abrasive particles had not been applied. The material was dried in an oven at 80° C. for a time sufficient to render the adhesive tacky to the touch. The second fibrous nonwoven web side of each laminate of Examples 5–7 then was slowly pressed against the adhesive-coated side of the abrasive sheet material by rolling a No. 60 Meyer rod over the top with only the pressure of the weight of the rod. The resulting structure was cured in an oven at 110–120° C. for ten minutes. The material was evaluated after standing at ambient temperature for 24 hours.

If desired, a pressure-sensitive adhesive may be used in place of the adhesive coating. This would eliminate the need for partial drying and subsequent curing.

EXAMPLES 14–16

The melt-extruded layer of each of the laminates of Examples 8–10 was coated with a make coat, abrasive particles, and a size coat as described for Examples 11–13.

The primary requirements of the loop substrate of the present invention for abrasive hook applications are peel strength, shear strength, and the absence of fiber lint when disengaged from the hook attachment. The performance of the materials obtained in Examples 11–16 was evaluated by:

Repeated attachment/detachment to assess the strength and consistency of adhesion (peel and shear), as well as linting tendency.

High speed revolution (>2500 rpm) under no pressure to assure that the disc remains attached to the pad. Observations were also made to make sure the disc does not 'wander' during use. Wandering may result in the exposure of hooks which may damage the surface being sanded. This also provides a qualitative valuation shear adhesion.

Verify the absence of hook penetration through the loop material to avoid the possibility of surface damage.

All of the materials of Examples 11–16 satisfactorily met the foregoing test criteria. As a practical matter, less curl of the substrate was observed when the second layer was a carded web, rather than a spunbonded web.

While the specification has been described in detail with respect to specific embodiments thereof, it will be appreciated by those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A releasably attachable abrasive sheet material which comprises:

a first fibrous nonwoven web having a first surface and a second surface and comprised of carded sheath-core bicomponent staple fibers, in which the fibers have a sheath-core melting point differential of at least about 20° C. and a length of from about 10 mm to about 65 mm;

a backing layer bonded to the second surface of the first fibrous nonwoven web; and a layer of abrasive particles bonded to the backing layer;

wherein the first fibrous nonwoven web has:

a thickness of at least about 0.15 mm and a basis weight of at least about 20 grams per square meter;

a pattern on the first surface thereof of continuous bonded areas formed only by the application of heat and pressure defining a plurality of discrete unbonded areas, wherein individual fibers within the discrete unbonded areas have at least a portion thereof extending into and bonded within the continuous bonded areas; and a percent bonded area of from about 20 to about 50 percent.

2. A releasably attachable abrasive sheet material which comprises:

a first fibrous nonwoven web having a first surface and a second surface and comprised of carded sheath-core bicomponent staple fibers, in which the fibers have a sheath-core melting point differential of at least about 20° C. and a length of from about 10 mm to about 65 mm;

a second fibrous nonwoven web bonded to the second surface of the first fibrous nonwoven web;

a film bonded to the second fibrous nonwoven web; and a layer of abrasive particles bonded to the film;

wherein the first fibrous nonwoven web has:

a thickness of at least about 0.15 mm and a basis weight of at least about 20 grams per square meter;

a pattern on the first surface thereof of continuous bonded areas formed only by the application of heat and pressure defining a plurality of discrete unbonded areas wherein individual fibers within the discrete unbonded areas have at least a portion thereof extending into and bonded within the continuous bonded areas; and a percent bonded area of from about 20 to about 50 percent.

3. The releasably attachable abrasive sheet material of claim 2, in which the layer of abrasive particles is bonded to the film by a layer of adhesive.

4. The releasably attachable abrasive sheet material of claim 2, in which the layer of abrasive particles is coated with a layer of adhesive.

5. The releasably attachable abrasive sheet material of claim 2, in which the fibers of the first fibrous nonwoven web have a length of from about 35 mm to about 55 mm.

6. The releasably attachable abrasive sheet material of claim 2, in which the thickness of the first fibrous nonwoven web is at least about 0.2 mm.

7. The releasably attachable abrasive sheet material of claim 6, in which the thickness of the first fibrous nonwoven web is from about 0.2 mm to about 1 mm.

8. The releasably attachable abrasive sheet material of claim 2, in which the first fibrous nonwoven web has a percent bonded area of from about 35 to about 45 percent.

9. A releasably attachable abrasive sheet material which comprises:

a first fibrous nonwoven web having a first surface and a second surface and comprised of carded sheath-core bicomponent staple fibers, in which the fibers have a sheath-core melting point differential of at least about 20° C. and a length of from about 10 mm to about 65 mm;

a second fibrous nonwoven web bonded to the second surface of the first fibrous nonwoven web;

a backing layer bonded to the second fibrous nonwoven web; and a layer of abrasive particles bonded to the backing layer;

wherein the first fibrous nonwoven web has:

a thickness of at least about 0.15 mm and a basis weight of at least about 20 grams per square meter;

a pattern on the first surface thereof of continuous bonded areas formed only by the application of heat and pressure defining a plurality of discrete unbonded areas, wherein individual fibers within the discrete unbonded areas have at least a portion thereof extending into and bonded within the continuous bonded areas; and a percent bonded area of from about 20 to about 50 percent.

10. The releasably attachable abrasive sheet material of claim 9, in which the layer of abrasive particles is bonded to backing layer by a layer of adhesive.

11. The releasably attachable abrasive sheet material of claim 9, in which the layer of abrasive particles is coated with a layer of adhesive.

12. The releasably attachable abrasive sheet material of claim 9, in which the fibers of the first fibrous nonwoven web have a length of from about 35 mm to about 55 mm.

13. The releasably attachable abrasive sheet material of claim 9, in which the thickness of the first fibrous nonwoven web is at least about 0.2 mm.

14. The releasably attachable abrasive sheet material of claim 13, in which the thickness of the first fibrous nonwoven web is from about 0.2 mm to about 1 mm.

15. The releasably attachable abrasive sheet material of claim 9, in which the first fibrous nonwoven web has a percent bonded area of from about 35 to about 45 percent.

16. The releasably attachable abrasive sheet material of claim 9, in which the second fibrous nonwoven web is a spunbonded web.

17. The releasably attachable abrasive sheet material of claim 9, in which the second fibrous nonwoven web is a web of carded staple fibers.

18. The releasably attachable abrasive sheet material of claim 17, in which the fibers of the second fibrous nonwoven web are the same as those employed in the first fibrous nonwoven web.

* * * * *